US005700572A

United States Patent [19]

Klatt et al.

[11] Patent Number: 5,700,572

[45] Date of Patent: Dec. 23, 1997

[54] PTFE FIBRE MATERIAL AND PROCESS FOR MAKING IT

[75] Inventors: Bruno Klatt; Manfred Horx, both of Wolfen; Hartmut Koelling, Dessau; Karlheinz Berndt, Bitterfeld; Gerhard Krueger; Hans-Joachim Kuenne, both of Magdeburg; Lothar Moerl, Hohenwarthe; Lothar Backhauss, Osterweddingen, all of Germany

[73] Assignees: Heraeus Elektrochemie GmbH, Rodenbach; Magdeburger Energie - und Umwelttechnik GmbH, Magdeburg, both of Germany

[21] Appl. No.: 325,285

[22] PCT Filed: Aug. 27, 1992

[86] PCT No.: PCT/DE92/00712

§ 371 Date: Jun. 2, 1995

§ 102(e) Date: Jun. 2, 1995

[87] PCT Pub. No.: WO93/05213

PCT Pub. Date: Mar. 18, 1993

[30] Foreign Application Priority Data

Sep. 12, 1991 [DE] Germany ..... 41 30 356.3

[51] Int. Cl.[6] ..... D02G 3/00; C25B 9/00; C25B 13/00

[52] U.S. Cl. ..... 428/357; 428/364; 204/252; 204/296

[58] Field of Search ..... 204/252, 296; 422/139; 428/357, 364

[56] References Cited

U.S. PATENT DOCUMENTS

| | | | |
|---|---|---|---|
| 2,760,917 | 8/1956 | Ward | 422/139 |
| 3,043,652 | 7/1962 | Schytil | 422/139 |
| 4,184,939 | 1/1980 | Kadija | 204/252 |
| 4,207,164 | 6/1980 | Kadija | 204/296 |
| 4,278,524 | 7/1981 | Kadija | 204/252 |
| 4,468,360 | 8/1984 | Kadija | 204/296 |
| 4,544,474 | 10/1985 | Kadija | 204/296 |
| 4,545,886 | 10/1985 | de Nora et al. | 204/252 |
| 4,853,189 | 8/1989 | Holland | 422/139 |
| 5,009,971 | 4/1991 | Johnson et al. . | |
| 5,188,712 | 2/1993 | Dilmore et al. | 204/296 |
| 5,266,276 | 11/1993 | Chinh et al. | 422/139 |
| 5,288,384 | 2/1994 | Banerjee | 204/252 |
| 5,365,006 | 11/1994 | Serrand | 422/139 |

FOREIGN PATENT DOCUMENTS

| | | |
|---|---|---|
| 0418155 | 3/1991 | European Pat. Off. . |
| 1355373 | 6/1974 | United Kingdom . |
| 8601841 | 3/1986 | WIPO . |

*Primary Examiner*—Newton Edwards
*Attorney, Agent, or Firm*—Jordan and Hamburg

[57] ABSTRACT

The invention provides a fiber material of PTFE and, optionally, hydrophilizing additives, for use in the production of diaphragms for the electrolysis of alkali chlorides, as well as for filter layers. The fiber material comprises fiber bundles and these, in turn, comprise individual microfibrils, there being irregularly shaped interstices between the microfibrils. The fiber material is produced in that a PTFE dispersion, consisting of a salt solution with PTFE particles and, optionally, hydrophilizing additives, is treated in a hot gas/vapor stream in a fluidized bed apparatus charged with inert solids. The method permits the fiber material to be produced also in larger quantities in an economic manner.

5 Claims, 1 Drawing Sheet

PTFE FIBRE MATERIAL AND PROCESS FOR MAKING IT

BACKGROUND OF THE INVENTION

The invention relates to a fiber material comprised of PTFE, suitable for use in a wide range of applications due to its new structure. For example, it may be used to produce diaphragms for the electrolysis of alkali chlorides and filter layers used for various engineering purposes. Moreover, the invention relates to a method for the production of this new fiber material. PTFE fibers are generally known as monofilament fibers, suitable for the production of staple fibers of different length and diameter, yarns and woven fabrics. The disadvantage of these prior art PTFE fibers is that filter layers or diaphragms cannot be produced solely from such fibers obtained by aspiration from a suitable dispersion. These fibers are generally too rigid and have too high a resilience.

According to a known method, PTFE fiber is produced by milling PTFE sodium chloride and inorganic additives, such as $ZrO_2$ and $TiO_2$, at elevated temperatures in a ball mill (GDR patent 244 365). The PTFE fibers, produced according to this very cumbersome and expensive method, are suitable in principle for use in fabricating filter layers and diaphragms. It must, however, be noted that the diaphragms produced solely from these fibers are inferior in performance to asbestos-containing diaphragms, especially when used in the electrolysis of alkali chlorides. This is apparently due to the structure of these PTFE fibers, which is monofilamentous in contrast to that of asbestos fibers.

OBJECTS AND SUMMARY OF THE INVENTION

An object of the invention is therefore to provide a fiber material of PTFE, which has a wide range of applications and that can be produced economically. Briefly stated, the invention provides a new structure of PTFE fibers suitable for the production of diaphragms for alkali chloride electrolysis or filter layers. Such material consists of fiber bundles, each comprised in turn of individual microfibrils, and including structure presenting irregularly shaped interstices between the microfibrils. This new type of fiberous PTFE, with which hydrophilizing additives can optionally be admixed, can be economically manufactured.

DETAILED DESCRIPTION OF THE INVENTION

Figure 1:
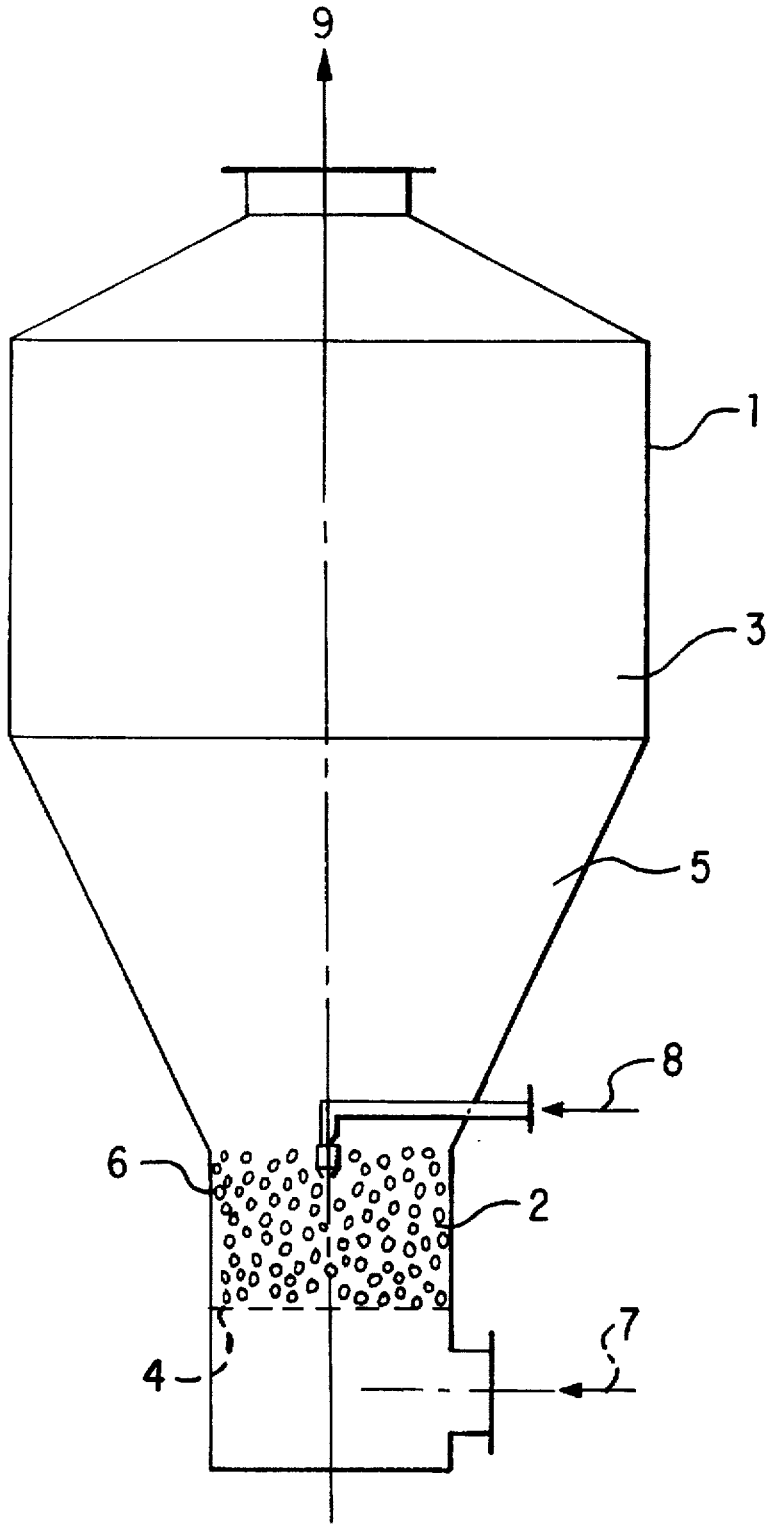
FIG. 1 is a schematic view of a fluid bed apparatus for use in producing the PTFE fiber according to the invention.

Pursuant to the invention, a PTFE dispersion, consisting of a salt solution with PTFE particles and optionally hydrophilizing additives, is treated in a hot gas/vapor stream at temperatures between 140° C. and 210° C. in a fluidized bed apparatus of charged with inert solids of the type depicted in FIG. 1. The PTFE dispersion contains a salt solution, which consists preferably of NaCl and the concentration of which advantageously lies between 100 g/L and the saturation limit. The ratio of PTFE to sodium chloride can lie between 1:1 and 1:10, based upon the dry weight of each. Unlike other PTFE fibers, the fiber material according to the invention demonstrates a certain hydrophilicity even without the addition of special hydrophilizing agents.

For certain applications, however, it may be advisable to hydrophilize the fiber material further by means of suitable additives. These additives may include, for example, compounds from the group long known for providing these benefits, such group including zirconium dioxide, titanium dioxide, silicon dioxide, kaolin, aluminum oxide, magnesium oxide, magnesium hydroxide calcium carbonate, etc. In these cases, the mixing ratio of PTFE to the additive should lie between 20:1 and 1:5, based upon the dry weight of each.

Alternatively, the principle of polymer-identical modification may be used to modify the hydrophilic properties of the fiber material according to the invention. For this modification, a quantity of a PTFE powder, which has been highly functionalized by irradiation in an electron beam accelerator or in a gamma radiation source with an output of 2,000 to 10,000 kGy, optionally in the presence of ammonium or alkali sulfites, disulfites, hydrogen sulfites, carbonates, hydrogen carbonates or bisulfite adducts of carbonyl compounds or a mixture of these substances, is added to the aqueous PTFE dispersion. For purposes herein, PTFE powder so modified is referred to as a highly functionalized PTFE polymer-identical modifier. This polymer-identical modification provides fibers which are more chemically stable and which possess mechanical properties superior to those obtained by the addition of hydrophilizing additives.

The ratio, in which the PTFE is mixed with the highly functionalized PTFE, is preferably in a range between 100:1 and 3:1, based upon the dry weight of each. The parameters in the fluidized bed apparatus, which must be adjusted, relate to its structural design, as well as to the processes taking place in it. Referring now to FIG. 1., in the design of a fluidized bed apparatus 1, the following criteria must be observed:

- The cross-sectional area of a discharging chamber 3 must be 2 to 5 times as large as the cross-sectional area of a fluidizing chamber 2.
- The wall of an expansion chamber 5 is inclined at an angle of 20° to 40° to the vertical.
- The height of the fluidized bed apparatus 1 above a base 4, against which the fluidizing gas is impinging, is 5 to 20 times the cross-sectional dimension of the fluidizing chamber 2.
- The base 4, against which the fluidizing gas is impinging, has a free cross-sectional area of 5 to 25%.

With regard to inert solids 6 included within fluidized bed apparatus 1, the following conditions apply:

- The specific weight of the inert solids 6 must be greater than 2 g/cc and must not exceed 10 g/cc.
- The diameter of the inert solids is between 1 and 10 mm.
- There must be between 150 kg/m$^2$ and 500 kg/m$^2$ of inert solids 6 in the fluidizing chamber 2, depending on the cross-sectional area of the base 4, against which the fluidizing gas is impinging.

The following parameters are related to the processes taking place in the fluidized bed apparatus 1:

- The temperature selected for the gas/vapor stream entering the fluidizing chamber 2 through stream entry 7 should be between 270° and 340° C.
- The specific rate of the gas/vapor stream passed through the fluidizing chamber 2 is between 2 kg/m$^2$/sec and 9 kg/m$^2$/sec.
- Hourly, 250 kg to 1500 kg of the dispersion required for forming the fibers is introduced per m$^2$ of cross-sectional area of the fluidizing chamber 2.
- The temperature in the fluidized bed is adjusted within a range of 140° C. to 210° C.

In accordance with the invention, the dispersion of PTFE and salt solution, as described above is fed through a PTFE dispersion feed 8 into fluidizing chamber 2 of fluid bed apparatus 1. A fluidizing stream, comprising a vapor of gas and/or steam, is fed through steam entry 7 and raised through openings in base 4 and up through inert solids 6 in fluid chamber 2, exiting through a gas/vapor exit 9. As noted herein, when an inorganic agent is optionally used, it may be included in the aqueous PTFE dispersion prior to addition through dispersion feed 8.

Contrary to expectation rather than obtaining the resultant material in the form of powders, granulates, agglomerates or other compact solids, instead, fibrous shapes of different length are surprisingly formed in accordance with the invention. These fibrous shapes consist generally of fiber bundles, which in turn are composed of microfibrils. It is noted that the formulation of the mixture described above, as well as the parameters to be set in the fluidized bed apparatus are of great importance in practicing the invention.

The fact, that the fiber structure of the PTFE material in a fluidized bed apparatus in conjunction with the use of a concentrated salt solution was also an unexpected result.

The method according to the invention permits fiber material possessing the aforementioned characteristics to be produced in larger quantities than heretofore possible, in a technologically elegant and economical manner. It has the further advantage that, when the inventive process parameters are adhered to, the average fiber length can be adjusted within limits as desired. The different length of the fibers permits the properties of the filter layers and diaphragms, produced from this fiber material, to be controlled. For example, the permeability of the filters and diaphragms, as well as their average effective pore diameter and pore size distribution, may be varied by means of the ratio by weight of long fibers to short fibers.

The following examples describe typical implementations of the invention without limitation thereof.

EXAMPLE 1

The fluidized bed apparatus 1 with a cylindrical fluidizing chamber 2 of 150 mm diameter and the processes taking place in it are characterized by the following parameters:

a) The cross-sectional area of the discharging chamber 3 is 0.047 $m^2$.

b) The wall of the expansion chamber 5 is inclined at an angle of 30° to the vertical.

c) The fluidized bed apparatus 1 is 2 mm high above the base 4, impinged upon by the fluidizing gas.

d) The base 4, on which the fluidizing gas is impinging, has a specific free cross-sectional area of 10%.

e) Inert solids 6 (5 kg, 283 $kg/m^2$), with a diameter of 3 mm and a specific gravity of 7.8 g/cc, are used.

A gas/vapor stream (air) enters the fluidizing chamber 2 at a temperature of 290° C. and a rate of 283 kg/h and sets the inert solids into a fluidized state.

g) An aqueous PTFE dispersion (12 kg/h, 679 $kg/m^2/h$), in which 0.6 kg of PTFE particles with a particle size less than 1 μm, 3.8 kg of sodium chloride and 0.72 kg of zirconium dioxide are contained, is introduced into the fluidized bed layer.

h) The temperature in the fluidized bed layer is 160° C.

i) Approximately 5 kg of material containing PTFE fibers are discharged hourly from the fluidized bed layer.

A scanning electron microscopic analysis shows that the resultant PTFE fiber material consists of fiber bundles, which are formed, in turn, from microfibrils, with irregularly shaped interstices.

EXAMPLE 2

Like Example 1, but with the following change in g) above:

g) An aqueous PTFE dispersion (12 kg/h, 679 $kg/m^2/h$), in which 1.2 kg of PTFE particles with a particle size less than 1 μm, 3.8 kg of sodium chloride and 0.1 kg of highly functionalized PTFE are contained, is introduced into the fluidized bed layer.

EXAMPLE 3

Like Example 1, but with this change in g) above: g) An aqueous PTFE dispersion (12 kg/h, 679 $kg/m^2/h$), in which 1.3 kg of PTFE particles with a particle size less than 1 μm and 3.8 kg of sodium chloride are contained, is introduced into the fluidized bed layer.

We claim:

1. A fiber material, comprising:

PTFE; and structural form of said PTFE presenting a plurality of fiber bundles, said fiber bundles including discrete microfibrils, said microfibrils in physical arrangement with one another within each of said fiber bundles to define irregularly shaped interstices between said microfibrils.

2. The fiber material according to claim 1, further comprising a hydrophilizing additive.

3. The fiber material according to claim 2, wherein said hydrophilizing additive includes an inorganic agent.

4. The fiber material according to claim 3, wherein said inorganic agent is selected from the group consisting of zirconium dioxide, titanium dioxide, silicon dioxide, kaolin, aluminum oxide, magnesium oxide, magnesium hydroxide, and calcium carbonate.

5. The fiber material according to claim 2, wherein said hydrophilizing additive includes a highly functionalized PTFE polymer-identical modifier.

* * * * *